US006065662A

United States Patent [19]

Sauer

[11] Patent Number: 6,065,662

[45] Date of Patent: May 23, 2000

[54] TACKER

[75] Inventor: Marcus Sauer, Bad Schwartau, Germany

[73] Assignee: Joh. Friedrich Behrens AG, Ahrensburg, Germany

[21] Appl. No.: 09/085,849

[22] Filed: May 28, 1998

[30] Foreign Application Priority Data

May 30, 1997 [DE] Germany ..... 197 22 512

[51] Int. Cl.[7] ..... B25C 1/04

[52] U.S. Cl. ..... 227/130; 227/8

[58] Field of Search ..... 227/8, 130, 7

[56] References Cited

U.S. PATENT DOCUMENTS

| | | | |
|---|---|---|---|
| 3,112,489 | 12/1963 | Beckman et al. | 227/130 |
| 3,278,106 | 10/1966 | Becht et al. | 227/130 |
| 3,580,455 | 5/1971 | Cast | 227/8 |
| 3,606,128 | 9/1971 | Cast et al. | 227/130 |
| 3,713,573 | 1/1973 | Fehrs | 227/8 |
| 3,762,620 | 10/1973 | Geist | 227/8 |
| 3,784,077 | 1/1974 | Burke, Jr. et al. | 227/8 |
| 4,378,084 | 3/1983 | Scala | 227/8 |
| 4,432,483 | 2/1984 | Kuck | 227/8 |
| 4,629,106 | 12/1986 | Howard et al. | 227/8 |
| 5,083,694 | 1/1992 | Lemos | 227/8 |
| 5,551,621 | 9/1996 | Vallee | 227/8 |
| 5,564,614 | 10/1996 | Yang | 227/8 |
| 5,791,545 | 8/1998 | Lin | 227/8 |

FOREIGN PATENT DOCUMENTS 88 10 753 10/1988 Germany .

40 32 231 C2 6/1991 Germany .

*Primary Examiner*—Scott A. Smith
*Assistant Examiner*—Jim Calve
*Attorney, Agent, or Firm*—Vidas, Arrett & Steinkraus, P.A.

[57] ABSTRACT

A tacker for a fastener, with which a tacking plunger is drivable by a drive unit and expels the fastener via a muzzle tool, with a switch device comprising a switch plunger, for actuating the drive unit which has a pivotably mounted release lever for actuating the switch plunger, with a contact feeler which can be actuated on placing onto a subject, which is movably mounted on the muzzle tool and which is pretensioned by a spring into the idle position in which it protrudes beyond the muzzle tool, and with a safety device which is arranged between the contact feeler and the switch device and which has a transmission device, for preventing a release of the drive unit when the contact feeler is in its idle position, said safety device comprising a slide element which is movably mounted on the side of the release lever directed towards the switch plunger and which is coupled to the transmission device and is movable with the release lever relative to the transmission device so that in the idle position of the contact feeler it is located in a position in which the switch plunger on actuation of the release lever remains unactuated, and on actuation of the contact feeler is displaced into a position in which the switch plunger is actuated on actuation of the release lever, wherein the transmission device between the contact feeler and slide element comprises a flexible strip element.

20 Claims, 3 Drawing Sheets

-10-
II

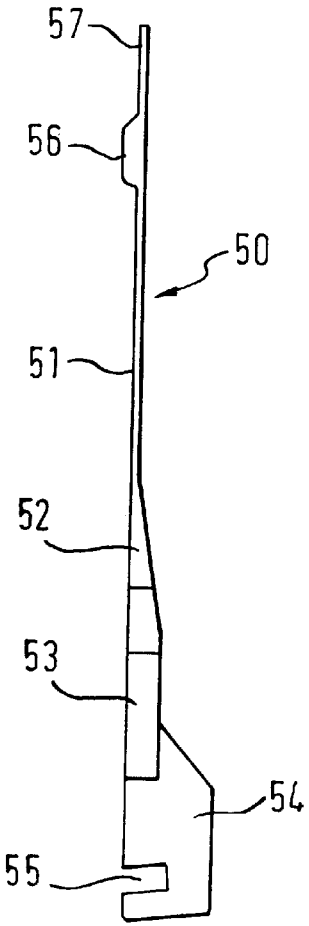
Fig. 4b
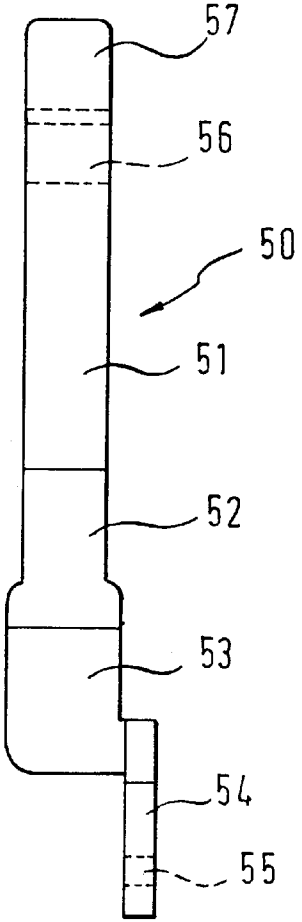
Fig. 4a
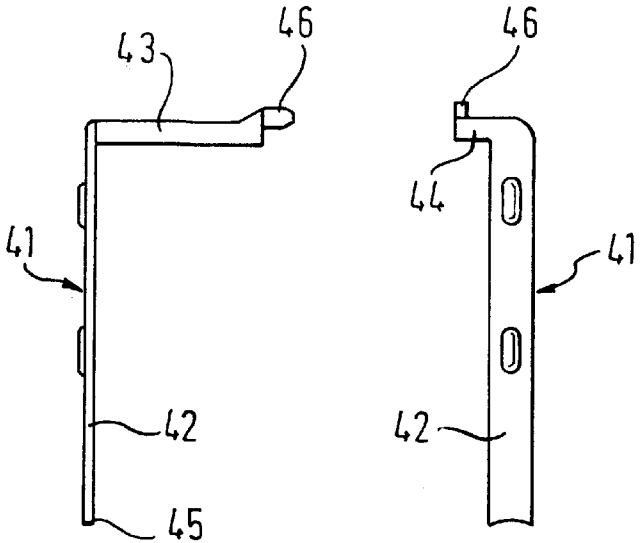
Fig. 3b
Fig. 3a
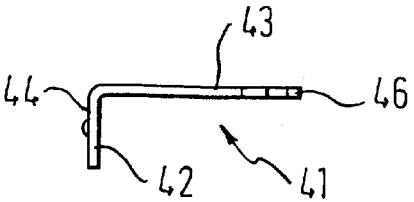
Fig. 3c

TACKER

BACKGROUND OF THE INVENTION

The invention relates to a tacker for fastening means according to the introductory part of claim 1.

Self-powered tackers require release safety devices corresponding to regulations of authorities. These are to prevent the tackers from being used as a fire arm. Furthermore by way of inconsiderate use there arises danger to the user and for persons who are located in the workplace by way of unintended contact of the release and likewise.

It is therefore known to mount a contact feeler on the muzzle tool of a tacker, which in its idle position projects over the muzzle tool and on contact of the tacker on the subject is displaced. Between the contact feeler and a switch device for releasing the drive unit there is usually arranged a linkage of bars. With the help of such a safety device it is achieved that a tacking shot is only released when the contact feeler as well as the release lever are actuated. With this one may differentiate between apparatus with contact operation (touch release) and apparatus with a sole release actuation.

With apparatus with a touch release the tacking procedure with the release lever actuated may be released by the mere placing of the contact feeler on the subject. Such an operating manner is usual where very quickly a multitude of fastening means are to be diven in, without there being required a precise attachment. At the same time however there is the danger that erroneous releases occur when the contact feeler is actuated by unintentional contact.

The sole release actuation is only applied with relatively large tackers or apparatus for large fastening means lengths (e.g. 130 mm). With an actuation of the release lever, with tackers with single shot release only a single shot is released in contrast to tackers with repetitive operation with which fastening means are continuously driven out with a frequency typical of the apparatus as long as the release lever is actuated. Firstly the contact feeler must be actuated before the release lever effects a release of the drive unit. In order to carry out a further tacking procedure, with some apparatus firstly the contact feeler must be lifted up and the release lever let go of. With other apparatus with a tacker which is placed on, by way of multiple actuation of the release lever several tacking procedures may be carried out (cf. DE-GM 88 10 753.1).

The known tackers have the disadvantage that their safety devices with a linkage of bars are complicated and prone to failure. These specifically act generally on a control element between the release lever and a switch plunger, wherein between the contact feeler and the control element a movement deflection is required and a relative movability between slide element and the linkage of bars must be ensured.

BRIEF SUMMARY OF THE INVENTION

Proceeding from this it is the object of the invention to make available a tacker for fastening means with a simplified and safely functioning release securement.

This object is achieved by a tacker with the features of claim 1.

The tacker for fastening means, according to the invention, has a tacking plunger which is drivable by a drive unit and which drives out the fastening means via a muzzle tool. The drive is preferably pneumatic, but may also be effected differently, e.g. electromagnetically or by electromotor. Furthermore there is present a switch device comprising a switch plunger for actuating the drive unit which has a pivotably mounted release lever for actuating the switch plunger. This lever may comprise an elongate deepening on the side directed towards the switch plunger. A contact feeler which can be actuated on placing on a subject is movably mounted on the muzzle tool and is pretensioned by way of a spring in the idle position in which it protrudes beyond the muzzle tool. Between the contact feeler and the switch device there is arranged a safety arrangement which comprises a transmission device and prevents a release of the drive unit when the contact feeler is in its idle position. Furthermore the safety device comprises a slide element movably mounted on the side of the release lever directed to the switch plunger. The transmission device is coupled to the slide element so that this in the idle position of the contact feeler is located in a position in which the switch plunger on actuation of the release lever remains unactuated. This may be based on the slide element blocking the release lever or the release lever in the pivoting region not reaching the switch plunger. On actuation of the contact feeler the slide element is displaced into a position in which the switch lever is actuated on operation of the release lever. This may be based on the slide element being displaced in the imagined extension of the switch punger and the switch plunger on actuation of the release lever or the slide element reaching into a position in which it does not block the release lever and the release lever on actuation for its part actuating the switch plunger. With this tacker the transmission device between the contact feeler and the slide element comprises a flexible strip element which serves the transmission of movement and due to its flexibility ensures movement deflections and relative movabilities. On the other hand the strip element is adequately stiff and/or guided such that on actuation of the contact feeler it exerts an adequate pressure force on the slide element for its displacement. According to the formation of the drive unit the tacker may be designed for single shot or repetitive operation. Furthermore the flexible strip element may be provided with such a stiffness and/or guide that with the release lever actuated the switch plunger may be actuated by actuating the contact feeler, i.e. a touch operation is possible.

With a preferred embodiment of the invention the contact feeler is the end region of an arm of an essentially L-shaped release clip which is guided in a channel parallel to the tacking plunger. The other arm is extended in a cavity permiting a movement in the expulsion direction, transversely to the tacking plunger towards the side of the switch device. Thus a simple transmission of the movement of the contact feeler towards the side of the muzzle tool at which the switch device is located is made possible.

Furthermore preferably the switch device is arranged in an inner angular region between a housing head and a housing grip directed laterally away from the upper region of the housing head. The flexible strip element is then after a simple deflection guided on the inner end of the release lever along the housing head to the muzzle tool. Here it may be connected to the other arm of the release clip.

The end of the other arm of the release clip may for connection purposes by lug-shaped or hook-shaped. Accordingly the associated end of the flexible strip element may comprise a receiver for the lug or the hook. For a rigid connection the receiver may be accommodated in a stiffened, rib-like end section of the flexible strip with an alignment perpendicular to the strip. The rib-like end section may in turn be arranged on a reinforced end plate of the flexible strip. Since the release clip is preferably laterally guided past on the shooting channel, the receiver may be arranged laterally of the imagined extension of the flexible strip.

The slide element may be directly formed on the other end of the strip, in particular as an integral thickening of the strip. It may have a roughly trapezoidal shape in the longitudinal section, which is advantageous for a displacement below the switch plunger. On the side of the slide element opposite the flexible strip there may project a shorter strip section which with a non-actuated contact feeler engages under the switch plunger and simplifies the sliding under of the slide element.

Prefer ably in the idle position the slide element rests on a hump on the lower side of the housing grip which supports the slide element on actuation of the release lever so that the release pin remains unactuated.

Advantageously the flexible strip element may be manufactured with a flexible strip, rib, reinforced end section, slide lement and/or projecting strip section as one piece from plastic.

BRIEF DESCRIPTION OF THE DRAWINGS

Further features and advantages of the invention can be deduced from the subsequent description of two embodiment examples by way of the attached drawings. In the drawings there are shown:

FIGS. 3*a* to *c* release clip of the same tacker in an enlarged lateral view (FIG. 3*a*), front view (3*b*) and plan view (FIG. 3*c*);

FIGS. 4*a* and *b* a flexible strip element of the same tacker in an enlarged front view (FIG. 4*a*) and lateral view (FIG. 4*b*);

DETAILED DESCRIPTION OF THE INVENTION

Figure 1:
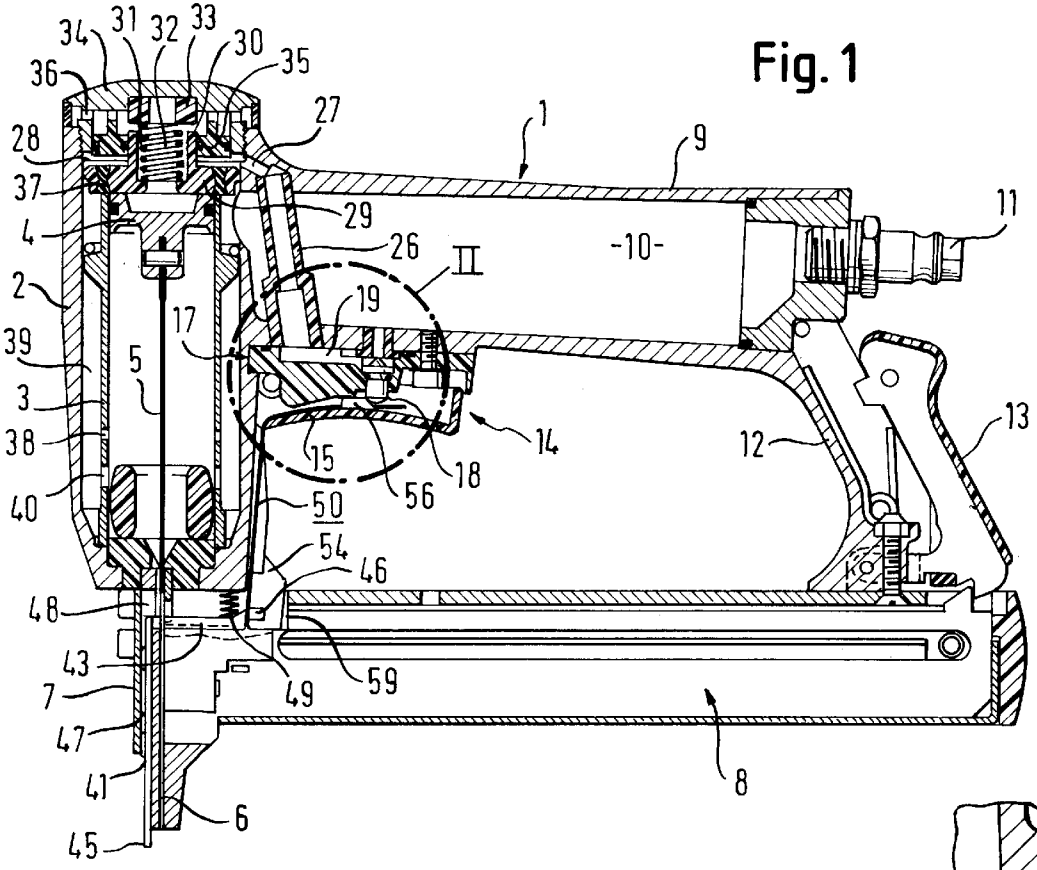
FIG. 1 the tacker in longitudinal section.

There is represented a pneumatically driven tacker. According to FIG. 1 this has a housing 1 which comprises in a housing head 2 a working cylinder 3 in which an operating piston 4 is arranged. Below on the operating piston 4 there is linked a tacking plunger 5 which at its lower end is guided in a tacking channel 6 of a muzzle tool 7. Laterally on the muzzle tool 7 there is linear magazine 8 for fastening means, which is connected to the tacking channel 6 via an opening.

The housing 1 further has a handle 9 in which a pressurized air supply space 10 is provided, which can be connected to the pressurized air source via a tubing connection 11. At the rear end the handle 9 is connected to the magazine 8 via a bridge 12. Here a closing lever 13 is linkedly mounted which serves for opening and closing the magazine 8 on refilling fastening means.

Figure 2:
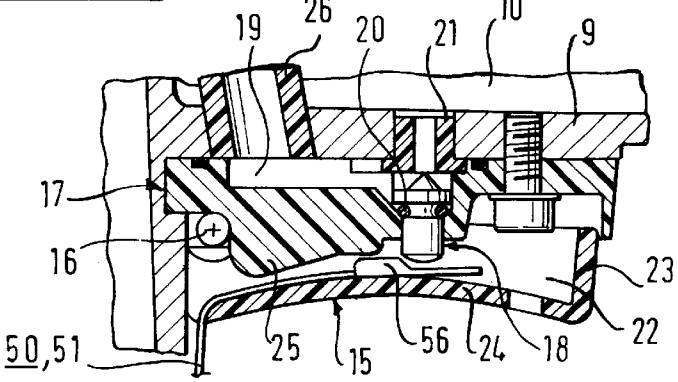
FIG. 2 enlarged detail II of the same tacker.

On the lower side of the handle 9 in the angular region between this and the housing head 2 there is arranged a switch device 14. As can be more clearly seen from FIG. 2 this has a release lever 15 which in the vicinity of the angular corner is pivotably mounted on a bolt 16 on a valve carrier 17. The valve carrier 17 accommodates a switch plunger 18 which on the one side projects out of the valve carrier 17 with a cylindrical section. On the other side in the hollow space 19 of the valve carrier 17 it is aligned to a cone section next to an O-seal-ring 20 concentrically to a sealing sleeve 21 which is connected to a pressurized air supply space 10 and which is seated in the handle 9.

The release lever 15 comprises an elongate deepening 22 which is directed towards the switch plunger 18 and which is closed on the two longitudinal sides and on the side distal to the bolt 16 by lateral walls 23. The floor 24 of the switch lever 15 is curved outwards somewhat towards the switch plunger 18.

The release lever 15 is dimensioned such that the deepening 22 on actuation of the lever can completely accomodate the switch plunger 18 without being actuated by the release lever 15 or by an intermediate lying transmission element which is described in more detail later.

Finally a hump 25 of the valve carrier 17, which is formed between the bolt 16 and the switch plunger 18 is referred to, this projecting next to the switch plunger 18 into the deepening 22 roughly as far as this plunger.

According to FIG. 1 the hollow space 19 is connnected to the valve space 28 via a small tube 26 and a housing bore 27, this valve space being arranged above the working cylinder 3. In the valve space 28 there is arranged a valve piston 29 which externally is sealingly guided in the housing head 2 and above comprises a hollow cylindrical piston shoulder 30 and an axial through-bore 31. The through-bore 31 has above an extended section in which a helical spring 32 is seated, this being supported on a valve seat element 33 in the housing lid 34.

In the housing lid 34 there is seated a sleeve 35 in which the piston shoulder 30 is sealingly guided and which for its part opposite a threaded shoulder is sealed to the collar of the housing lid. In the upper bearing region of the sleeve 35 on the housing lid 34 there are present air passages 36 from the inner space of the sleeve through the housing lid to the outside.

The valve element 29 above and below has a sealing element 37 with which it—according to its position—sealingly presses against the upper edge of the working cylinder 3 or the lower side of the sleeve 35.

Further radial bores 38 of the working cylinder 3 are referred to which connect to working volume to a recuperating air chamber 39 surrounding the working cylinder. The recuperating air chamber 39 in the vicinity of the muzzle tool 7 is connected to the working volume via radial bores 40 of a larger cross section.

In the muzzle tool 7 there is arranged a release clip 41. This according to FIG. 3 is formed essentially L-shaped, with a long arm 42 and a short arm 43 which is displaced somewhat laterally to the longer arm via a connection piece 44. The free end region of the long arm 42 forms the contact feeler 45. The free end of the short arm 43 is formed as a lug 46.

According to FIG. 1 the long arm 42 is guided in a channel 47 of the muzzle tool 7 parallel to the tacking channel 6. Below the housing head 2 the channel 47 opens into a transversely aligned cavity 48 through which the short arm 43 extends next to the tacking channel 6. The cavity 48 is so high that the short arm 43 or displacement of the long arm 42 in its channel may carry out a lifting movement up to the lower edge of the muzzle tool 7. Here the short arm 43 is loaded by a helical spring 49 supported on the lower side of the housing head 2, so that the contact feeler 45 below projects from the muzzle tool 7 when this is not placed on. The lug 46 projects on the side of the switch device 14 beyond the imagined extension of the wall of the housing head 2.

Between the release clip 41 and the switch device 14 there is arranged a flexible strip element 50. According to FIG. 4 this has a flexible strip 51 which at one end is connected over a region 52 of a gradually increasing wall thickness to an end plate 53. Laterally to the end plate there is attached a rib-like end section 54 which runs perpendicular to the strip 51 and on one side comprises a receiver 55 for the lug 46, which runs perpendicularly to the strip 51. At the other end the strip 51 carries a slide element 56 which is formed as a thickening with a trapezoidal longitudinal section. On the other side of the slide element 56 there projects a short flexible strip element 57. The strip element is manufactured from one piece of plastic (e.g. PA or PP).

The flexible strip element 50 with the end section 54 is set into a corresponding relief 58 between the magazine 8 and the muzzle tool 7 and accommodates the lug 46 in its receiver 55. With its end plate 53 and the transition section 52 it bears on the outer side of the housing head 2. The flexible strip 51 is guided into the elongate deepening 22 on the open inner side of the switch lever 15 and here lies on the floor 24 of the release lever 15. Here there is arranged also the slide element 56 which in the shown position is located in the region of the hump 15.

The tacker functions as follows:

In the initial position according to FIG. 1 the release lever 15 cannot be actuated since the pivoting thereof is prevented by the slide element 56 arranged between the floor 24 and the hump 25. Then the pressurized air supply space 10 is connected to the valve space 28 via the hollow space 19, the small tube 26 and the housing bore 27. Pressurized air from the pressurized air supply space 10 thus impinges the upper acting surface of the valve piston 29. By way of this and by way of the pressure of the helical spring 31 the valve piston 29 is sealingly pressed against the upper edge of the working cylinder 3. The working piston volume above the working piston 4 is connected via the passage bore 31 to the inner space of the sleeve 35 and via the through-flow openings 36 to the environment. As a result of this the working piston 4 remains in the position shown.

On placing the muzzle tool 7 onto a subject the release clip 41 is displaced upwards against the effect of a spring 49. At the same time the flexible strip element 50 is displaced with its lower region towards the switch device 14 and with its upper region within the deepening 22 of the release lever 15. By way of this the slide element 56 is displaced under the switch plunger 18. If now the release lever 15 is actuated the slide element 56 presses on the switch plunger 18 and this also is actuated. By way of this the hollow space 19 is separated from the pressurized air supply space 10 and by lifting off the O-ring 20 is connected to the atmosphere. As a result of this pressurized air only acts from the pressurized air supply space 10 directly onto the the lower acting surface of the valve piston 29 so that this is displaced against the effect of the flat spiral spring 32 into its upper open position in which the piston with the upper edge of its piston shoulder 30 sealingly presses against the valve seat element 33. By way of this the connection of the working stroke space to the atmosphere is interrupted. At the same time a connection between the pressurized air supply space 10 and a working cylinder 3 is created by which means the working piston 4 is driven downwards in a stroke-like manner. With this from the tacking plunger 5 a fastening element following through from the magazine 8 is expelled through the muzzle tool 7.

After release of the release lever 15 this is moved back into the original position according to FIG. 1 by the switch plunger 18 which is impinged by pressurized air from the pressurized air supply space 10. As a result of this the upper acting surface of the working piston 29 is again impinged with pressurized air and the valve piston is moved back into it shown lower closing position. Due to this the connection of the working stroke space to the atmosphere is again created. The recuperating air which, in the lowermost piston position, flowed through the radial bores 38 into the recuperating air chamber 39 via further radial bores 40 reaches into the working stroke space on the under side of the working piston 4 and drives this piston back into its original position according to FIG. 1.

Then a renewed releasing is possible without the tacker again having to be placed on. Of course before a further tacking procedure it may be lifted up and set on another location. A release with an actuated release lever 15 by way of the mere placing on of the muzzle tool 7 is however not possible since the lever actuation fixes the slide element 56 between the hump 25 and the floor 24 and the flexible tape 51 is thrown out only between the end section 54 and the slide element 56. With a stiffer design of the tape 51 or omitting the hump 25 a touch release is however also possible.

The design according to FIG. 5 corresponds largely to the previously described one. In as far as this is concerned identical reference numerals are used and the above explanations are referred to. Hereinafter only the differences are explained.

The valve carrier 17 has on the lower side a hump 25' which is displaced further away from the switch lever towards the bolt 16. The lower side of the hump 25' is is roughly inclined corresponding to the region of the floor 24 of the release lever 15, which is arranged thereunder.

Further the floor 24 of the release lever 15 on the side facing towards the switch plunger 18 has a cam-like or button-like projection 58 arranged in the extension of the switch plunger.

The strip element 50 has at the upper end of its flexible strip 51 only the slide element 56. On the other side there projects a flexible strip section.

Figure 5A:
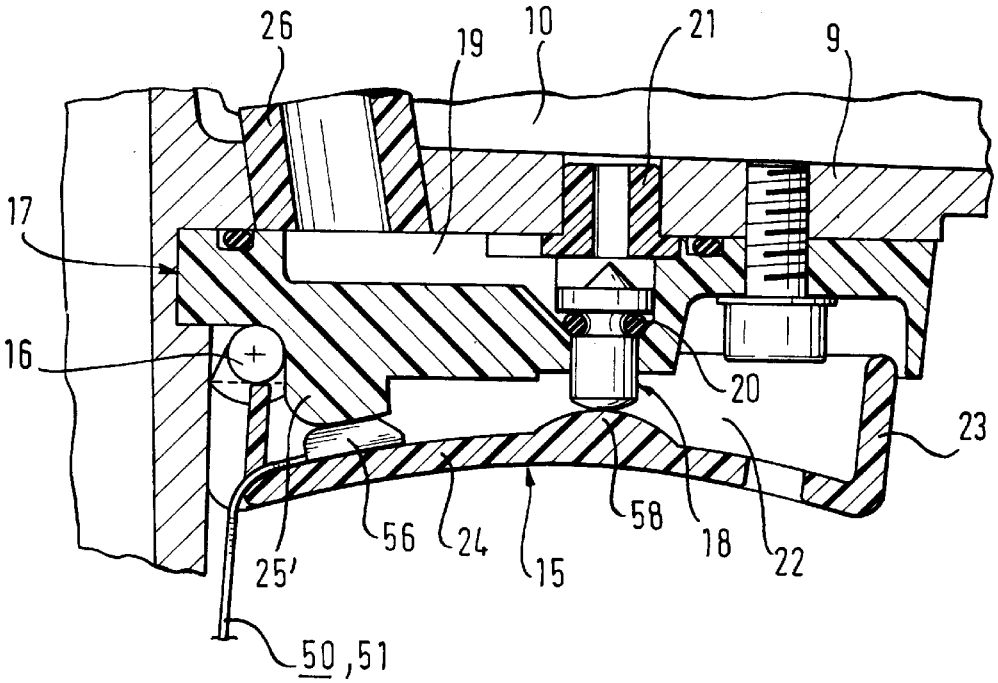
FIGS. 5*a* and *b* the detail corresponding to FIG. 2 of another tacker in the idle position (FIG. 5*a*) and on actuation of the contact feeler (FIG. 5*b*).

In the idle position of the contact feeler the slide element 56 is located in the position according to FIG. 5*a*, i.e. between the hump 25' and the floor 24 of the release lever 15. In this position it prevents the release lever 15 from pivoting. In this position the switch plunger 18 is not actuated by the projection 58.

Figure 5B:
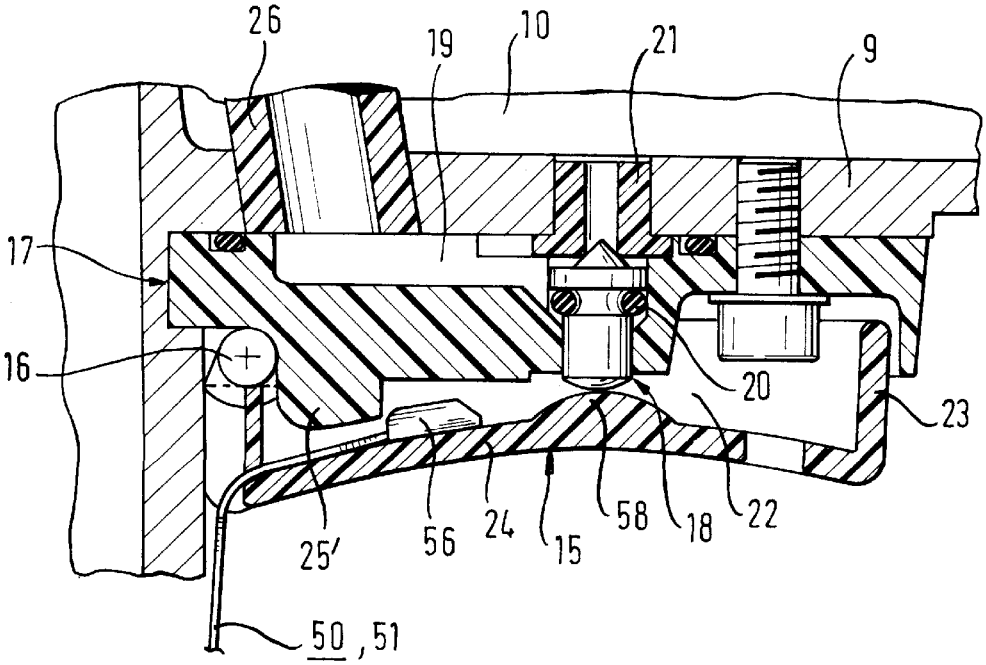

On actuation of the contact feeler the strip element 50 is displaced according to FIG. 5*b* so that the slide element 56 moves into the free space between the hump 25' and the switch plunger 18. Then the release lever 15 may be actuated and the tacking procedure released.

Instead of this the slide element 56 can as a rule in the idle position also sit on a plane surface of the valve carrier 17 and by way of this block the release lever 15. On actuation of the contact feeler the slide element 56 may be moved over a relief of the valve carrier 17, which permits an actuation of the release lever.

I claim:

1. A tacker for a fastener, with which a tacking plunger is drivable by a drive unit and expels the fastener via a muzzle tool, with a switch device comprising a switch plunger, for actuating the drive unit which has a pivotably mounted release lever for actuating the switch plunger, with a contact feeler which can be actuated on contacting a workpiece, which is movably mounted on the muzzle tool and which is pretensioned by a spring into an idle position in which it protrudes beyond the muzzle tool, and with a safety device which is arranged between the contact feeler and the switch device and which has a transmission device, for preventing a release of the drive unit when the contact feeler is in its idle position, said safety device comprising a slide element which is movably mounted on a side of the release lever directed towards the switch plunger and which is coupled to the transmission device and is movable with the release lever relative to the transmission device wherein in the idle position of the contact feeler, the side element is located in a position in which the switch plunger on actuation of the release lever remains unactuated, and on actuation, of the contact feeler, the side element is displaced into a position in which the switch plunger is actuated on actuation of the release lever, wherein the transmission device between the contact feeler and slide element comprises a flexible strip element, wherein the switch device is arranged in an inner angular region between a housing head and a housing grip directed laterally away from the upper region of said housing head, wherein the pivoting axis of the release lever is located near to an angle corner and wherein the flexible strip element includes a flexible strip section that is linked around on an inner end of the release lever and further includes a region of increasing wall thickness that is connected to the flexible strip section and that is guided along the housing head to the muzzle tool.

2. A tacker according to claim 1, wherein the slide element as a result of its coupling to the transmission device in a rest position of the contact feeler is located outside of an imagined extension of the switch plunger and on actuation of the switch plunger is located within the imagined extension of the switch plunger and the switch plunger on actuation of the release lever remains unactuated when the contact feeler is located in the idle position and the slide element actuates the switch plunger on actuation of the release lever when the contact feeler is actuated.

3. A tacker according to claim 1, wherein a hump is arranged on a lower side of a valve carrier and in the idle position of the contact feeler the slide element is arranged in the region of the hump and on actuation of the release lever presses against the hump and by way of this prevents a pivoting of the release lever.

4. A tacker according to claim 1, wherein the slide element on actuation of the contact feeler is located in a position outside of the imagined extension of the switch plunger and the release lever on its actuation actuates the switch plunger.

5. A tacker according to claim 4, wherein within the imagined extension of the switch plunger a projection is arranged on the inner side of the release lever, which on actuation of the release lever actuates the switch plunger.

6. A tacker according to claim 1, wherein a relief is arranged on the lower side of the valve carrier and on actuation of the contact feeler an actuation of the release lever moves the slide element into the relief and actuates the switch plunger.

7. A tacker according to claim 1, wherein the slide element is mounted in an elongate deepening on the side of the release lever directed towards the switch plunger.

8. A tacker according to claim 1, wherein the contact feeler is the end region of the one arm of an essentially L-shaped release clip which is guided in a channel parallel to the tacking plunger, and whose other arm is extended in a cavity permitting movement in an expulsion direction, transversely towards the side of the switch device.

9. A tacker according to claim 8, wherein the end of the other arm of the release clip reaches roughly to the imagined extension of the angular arm formed by the housing head and is connected to the flexible strip element.

10. A tacker according to claim 8, wherein the end of the other arm of the release clip is formed lug-shaped or hook-shaped.

11. A tacker according to claim 10, wherein an end section of the flexible strip element comprises a receiver for a lug or the hook.

12. A tacker according to claim 11, wherein the receiver is formed in a stiffened elongate end section of the flexible strip element, which runs perpendicular to the flexible strip of said element.

13. A tacker according to claim 12, wherein the elongate end section is arranged on a reinforced end plate of the flexible strip element.

14. A tacker according to claim 13, wherein the flexible strip, the rib, the reinforced end section, the slide element are formed of one piece from plastic.

15. A tacker according to claim 11, wherein the receiver is arranged laterally of an imagined extension of the flexible strip.

16. A tacker according to claim 1, wherein the slide element is formed on the other end of the strip element.

17. A tacker according to claim 1, wherein the slide element in longitudinal section is roughly trapezoidal.

18. A tacker according to claim 1, wherein on an other side of the slide element there projects a short strip section.

19. A tacker according to claim 1, wherein the flexible strip element along the housing is guided at least partly in a channel and has a stiffness permitting an actuation of the switch plunger by displacing the slide element.

20. A tacker according to claim 19, wherein the flexible strip element is at least partly manufactured from metal.

* * * * *